US006254514B1

(12) United States Patent
Maresh et al.

(10) Patent No.: US 6,254,514 B1
(45) Date of Patent: Jul. 3, 2001

(54) EXERCISE METHODS AND APPARATUS

(76) Inventors: Joseph D. Maresh, 19919 White Cloud Cir., West Linn, OR (US) 97068; Kenneth W. Stearns, 8009 Cedel, Houston, TX (US) 77055

( * ) Notice: Subject to any disclaimer, the term of this patent is extended or adjusted under 35 U.S.C. 154(b) by 0 days.

This patent is subject to a terminal disclaimer.

(21) Appl. No.: 09/290,439

(22) Filed: Apr. 13, 1999

Related U.S. Application Data

(63) Continuation of application No. 08/839,990, filed on Apr. 24, 1997, now Pat. No. 5,893,820.

(51) Int. Cl.[7] ..... A63B 69/16; A63B 22/04
(52) U.S. Cl. ..... 482/52; 482/51; 482/70
(58) Field of Search ..... 482/51, 52, 53, 482/57, 70, 71, 60, 62, 79, 80

(56) References Cited

U.S. PATENT DOCUMENTS

| | | | | |
|---|---|---|---|---|
| 4,185,622 | | 1/1980 | Swenson | 128/25 B |
| 4,786,050 | | 11/1988 | Geschwender | 272/73 |
| 5,186,697 | | 2/1993 | Rennex | 482/52 |
| 5,242,343 | | 9/1993 | Miller | 482/57 |
| 5,279,529 | | 1/1994 | Eschenbach | 48/57 |
| 5,295,928 | | 3/1994 | Rennex | 482/52 |
| 5,352,169 | | 10/1994 | Eschenbach | 482/57 |
| 5,383,829 | * | 1/1995 | Miller | 482/57 |
| 5,423,729 | | 6/1995 | Eschenbach | 482/70 |
| 5,518,473 | | 5/1996 | Miller | 482/57 |
| 5,529,554 | | 6/1996 | Eschenbach | 482/57 |
| 5,529,555 | | 6/1996 | Rodgers, Jr. | 482/57 |
| 5,540,637 | | 7/1996 | Rodgers, Jr. | 482/52 |
| 5,549,526 | | 8/1996 | Rodgers, Jr. | 482/57 |
| 5,562,574 | | 10/1996 | Miller | 482/51 |
| 5,573,480 | | 11/1996 | Rodgers, Jr. | 482/57 |
| 5,637,058 | | 6/1997 | Rodgers, Jr. | 482/51 |
| 5,893,820 | * | 4/1999 | Maresh et al. | 482/51 |

* cited by examiner

*Primary Examiner*—Stephen R. Crow

(57) ABSTRACT

An exercise apparatus includes a force receiving member movable relative to a frame. A roller is rotatably mounted on a first crank and supports a rearward portion of the force receiving member. A link is rotatably interconnected between a second crank and an intermediate portion of the force receiving member. The cranks, the roller, and the link cooperate with the force receiving member to move the latter in a desired path.

17 Claims, 10 Drawing Sheets

EXERCISE METHODS AND APPARATUS

CROSS-REFERENCE TO RELATED APPLICATION

This is a continuation of U.S. patent application Ser. No. 08/839,990, filed on Apr. 24, 1997 (U.S. Pat. No. 5,893,820).

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

In one respect, the present invention may be seen to provide a novel linkage assembly and corresponding exercise apparatus suitable for linking circular motion to relatively more complex, generally elliptical motion. In particular, a forward portion of a foot platform (or other force receiving member) is movably connected to a frame; a rearward portion of the foot platform is rollably connected to a flywheel (or other crank member); and a link is rotatably interconnected between the flywheel and an intermediate portion of the foot platform. As the flywheel rotates, it moves the foot platform up and down, and the link moves the foot platform back and forth, thereby causing the foot platform to travel through a generally elliptical path.

In another respect, the present invention may be seen to provide a novel linkage assembly and corresponding exercise apparatus suitable for linking reciprocal motion to relatively more complex, generally elliptical motion. In particular, a suspended link is rotatably connected to a frame member; and a relatively lower portion of the suspended link is rotatably connected to the forward portion of the foot platform (generally opposite the portion connected to the flywheel). As the foot platform moves through its generally elliptical path, the handle member pivots back and forth relative to the frame.

In yet another respect, the present invention may be seen to provide a novel linkage assembly and corresponding exercise apparatus suitable for adjusting the angle of the generally elliptical path of motion relative to a horizontal surface on which the apparatus rests. In particular, the frame member to which the suspended link is connected is movably mounted on the frame; and a pin extends through the frame member and into engagement with one of a plurality of holes in the frame to selectively secure the frame member at a particular elevation above the horizontal surface. A relatively higher pin location results in a relatively more strenuous, "uphill" exercise motion.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
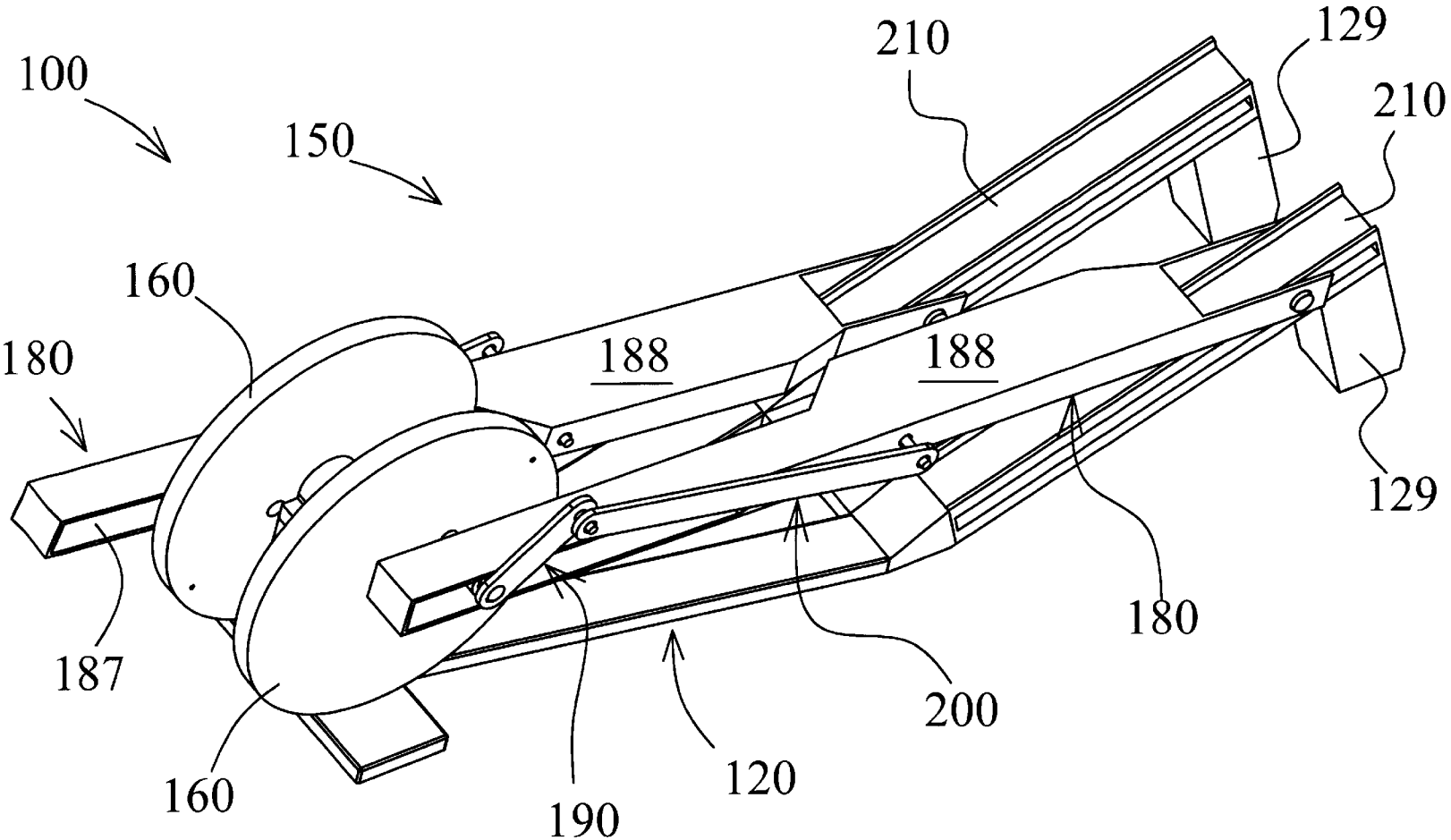
FIG. 1 is a perspective view of an exercise apparatus constructed according to the principles of the present invention.

An exercise apparatus constructed according to the principles of the present invention is designated as 100 in FIGS. 1–6. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180. The term "elliptical motion" is intended in a broad sense to describe any closed path of motion having a relatively longer first axis and a relatively shorter second axis (which extends perpendicular to the first axis).

The frame 120 includes a base 122 which is designed to rest upon a generally horizontal floor surface 99. The apparatus 100 is generally symmetrical about a vertical plane extending lengthwise through the base 122, the only exception being the relative orientation of certain parts of the linkage assembly 150 on opposite sides of the plane of symmetry. Thus, like reference numerals are used to designate both the "right-hand" and "left-hand" parts on the apparatus 100, and when reference is made to parts on only one side of the apparatus 100, it is to be understood that similar parts are disposed on the opposite side of the apparatus 100. Those skilled in the art will also recognize that the portions of the frame 120 which are intersected by the plane of symmetry exist individually and thus, do not have any "opposite side" counterparts. Furthermore, to the extent that reference is made to "forward" or "rearward" portions of the apparatus 100, it is to be understood that a person could exercise on the apparatus 100 while facing in either direction relative to the linkage assembly 150.

Figure 2:
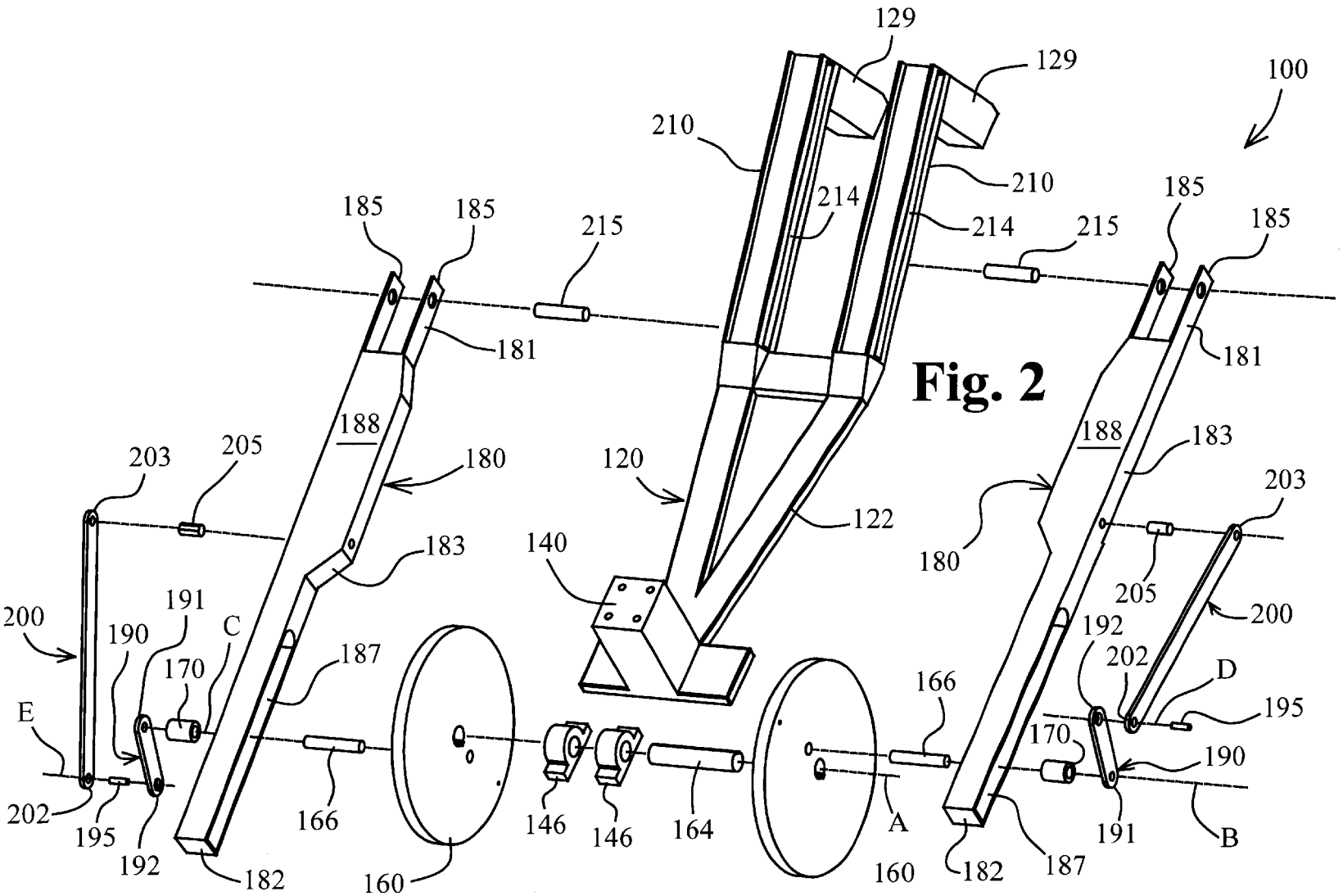
FIG. 2 is an exploded perspective view of the exercise apparatus of FIG. 1.
Figure 3:
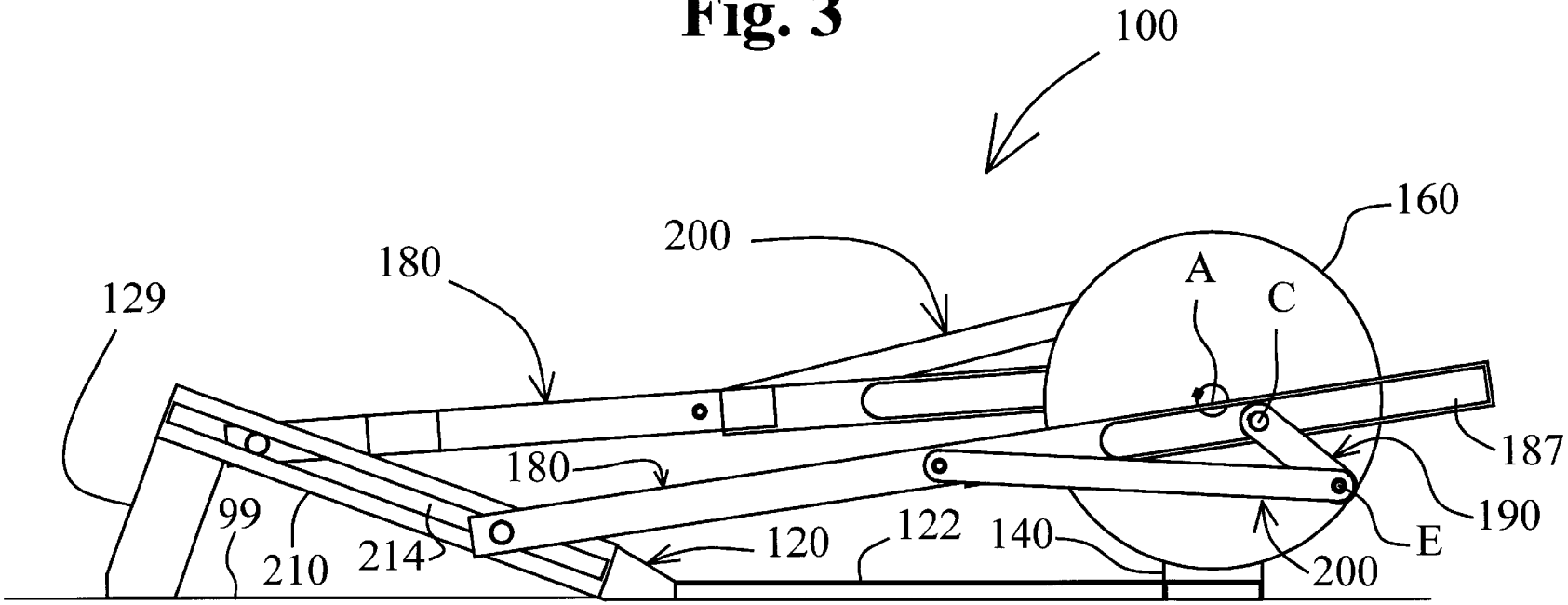
FIG. 3 is a side view of the exercise apparatus of FIG. 1.
Figure 4:
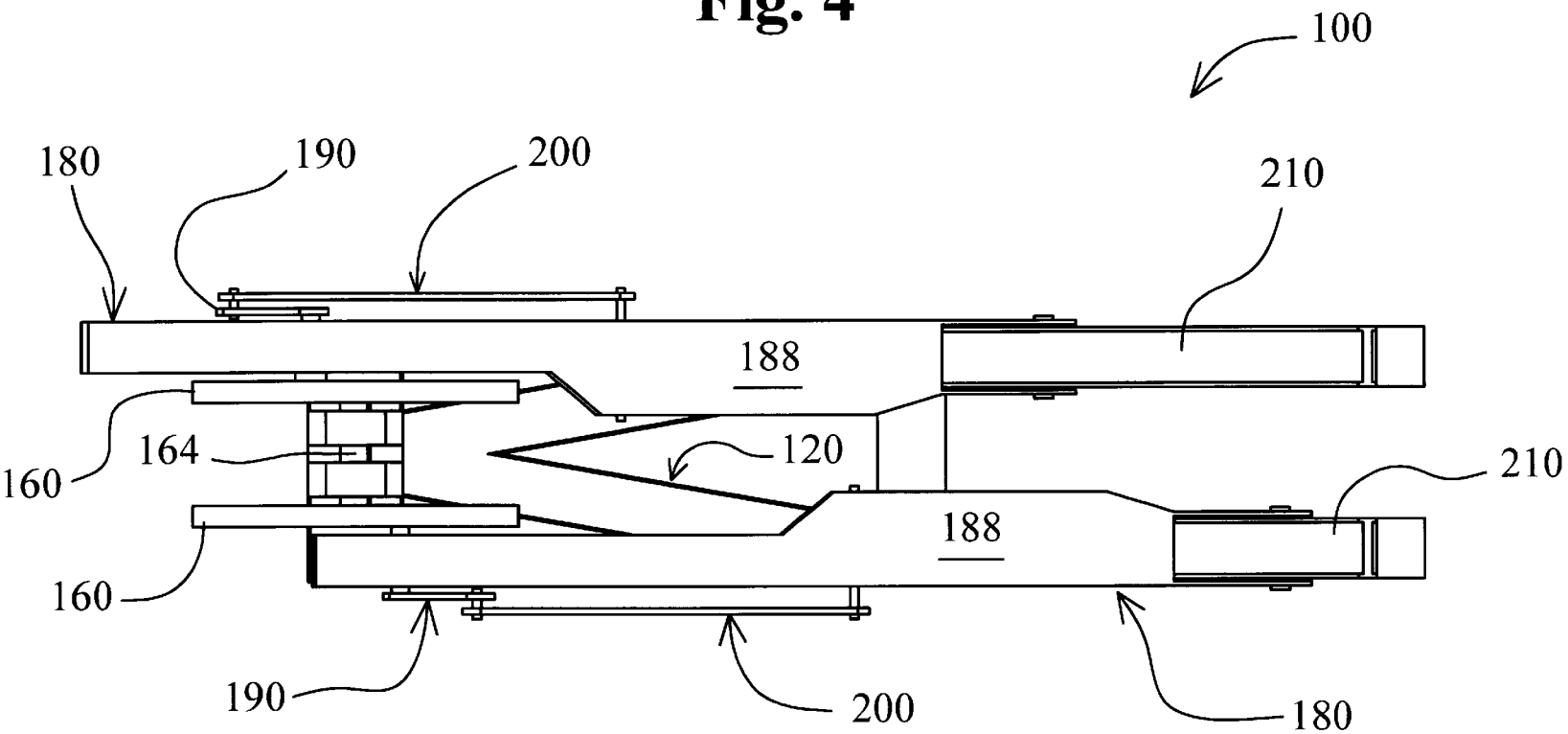
FIG. 4 is a top view of the exercise apparatus of FIG. 1.
Figure 5:
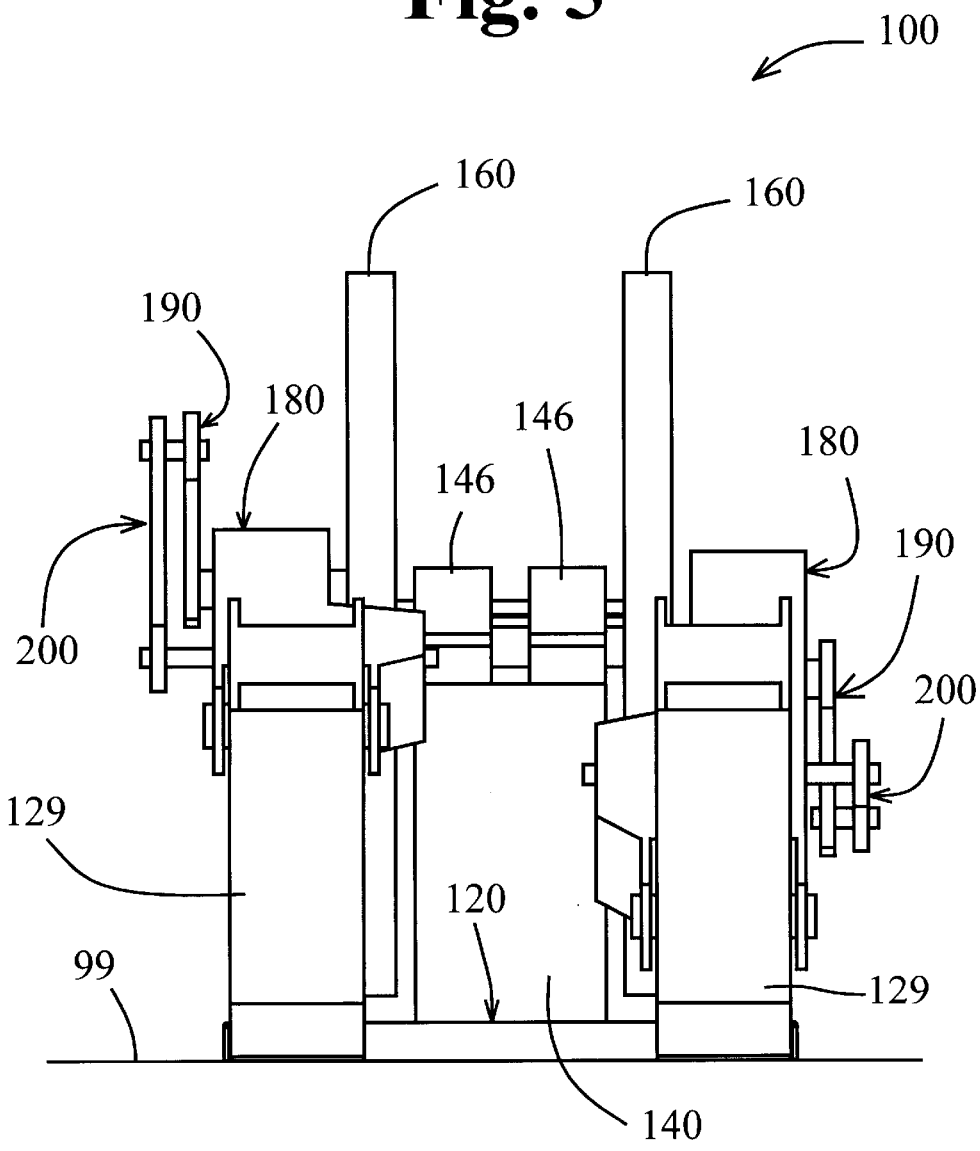
FIG. 5 is a front view of the exercise apparatus of FIG. 1.
Figure 6:
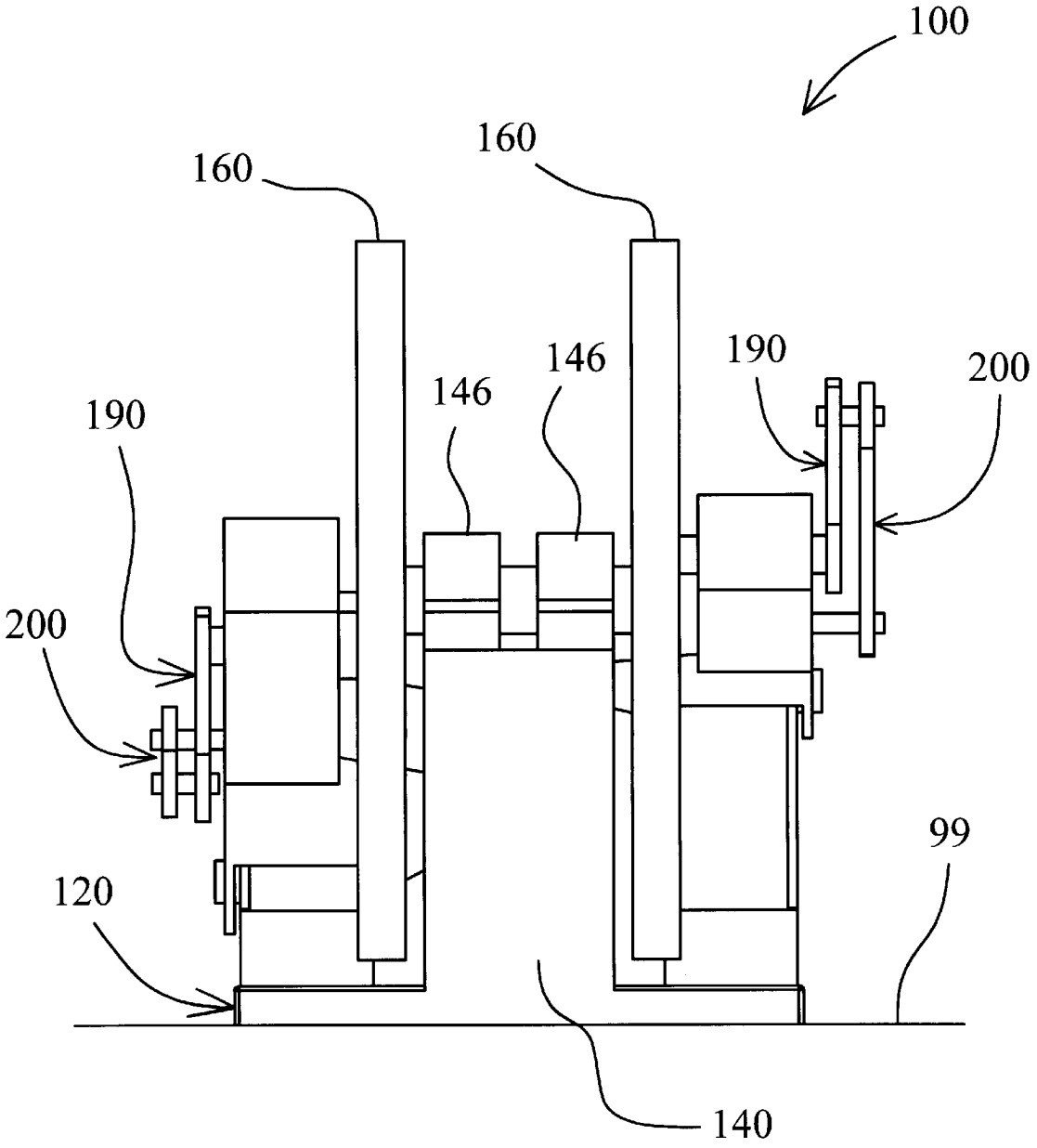
FIG. 6 is a rear view of the exercise apparatus of FIG. 1.
Figure 7A:
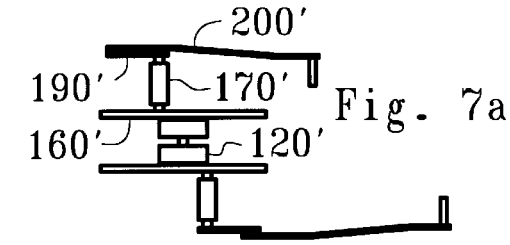
FIG. 7*a* is a top view of part of the linkage assembly on the exercise apparatus of FIG. 1.
Figure 7B:
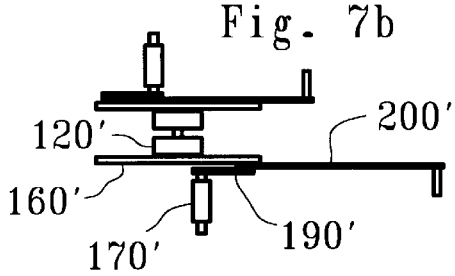
FIG. 7*b* is a top view of a linkage assembly similar to that of FIG. 7*a,* showing a second, discrete arrangement of the linkage assembly components.
Figure 7C:
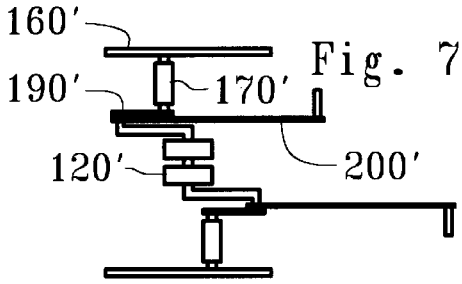
FIG. 7*c* is a top view of a linkage assembly similar to that of FIG. 7*a,* showing a third, discrete arrangement of the linkage assembly components.
Figure 7D:
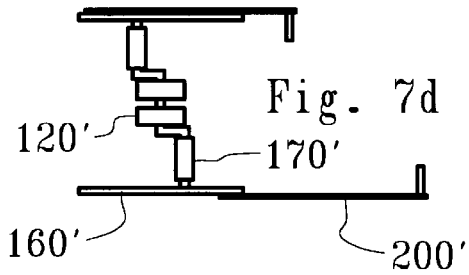
FIG. 7*d* is a top view of a linkage assembly similar to that of FIG. 7*a,* showing a fourth, discrete arrangement of the linkage assembly components.
Figure 7E:
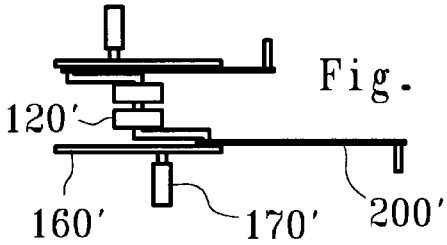
FIG. 7*e* is a top view of a linkage assembly similar to that of FIG. 7*a,* showing a fifth, discrete arrangement of the linkage assembly components.
Figure 7F:
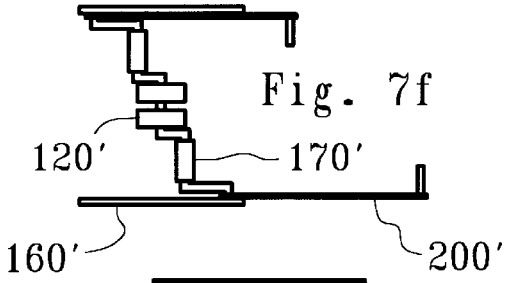
FIG. 7*f* is a top view of a linkage assembly similar to that of FIG. 7*a,* showing a sixth, discrete arrangement of the linkage assembly components.
Figure 7G:
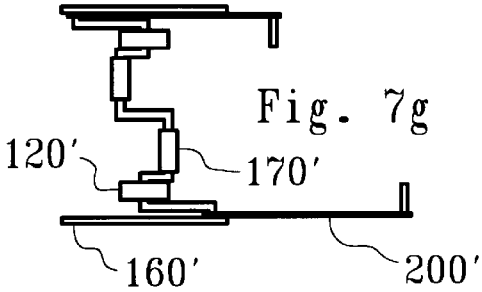
FIG. 7*g* is a top view of a linkage assembly similar to that of FIG. 7*a,* showing a seventh, discrete arrangement of the linkage assembly components.
Figure 7H:
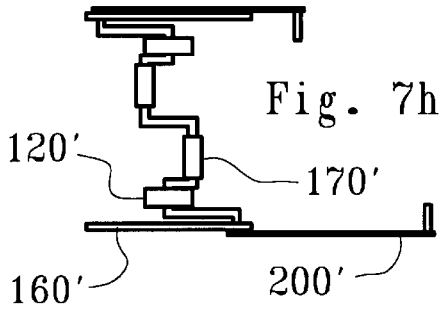
FIG. 7*h* is a top view of a linkage assembly similar to that of FIG. 7*a,* showing an eighth, discrete arrangement of the linkage assembly components.
Figure 7I:
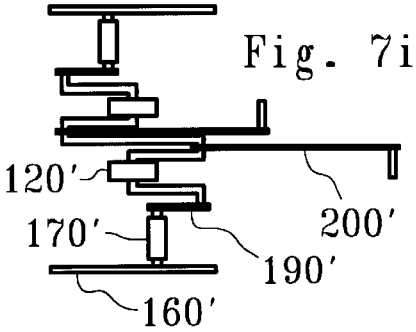
FIG. 7*i* is a top view of a linkage assembly similar to that of FIG. 7*a,* showing a ninth, discrete arrangement of the linkage assembly components.
Figure 7J:
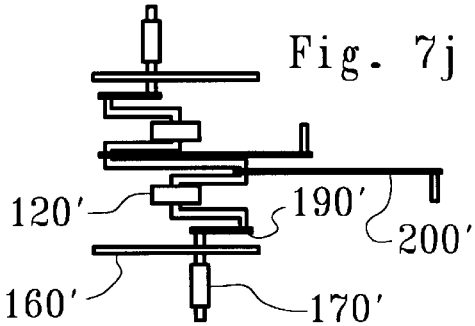
FIG. 7*j* is a top view of a linkage assembly similar to that of FIG. 7*a,* showing a tenth, discrete arrangement of the linkage assembly components.

As shown in FIG. 2, a rearward stanchion 140 extends perpendicularly upward from the base 122 and supports a pair of bearing assemblies 146. An axle 164 is inserted through holes (not numbered) in the bearing assemblies 146 to support a pair of flywheels 160 in a manner known in the art. For example, the axle 164 may be inserted through the bearing assemblies 146, and then one of the flywheels 160 may be fixed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

On each side of the apparatus 100, a radially displaced shaft 166 is rigidly secured to the flywheel 160 by means known in the art. For example, the shaft 166 may be inserted into a hole (not numbered) in the flywheel 160 and welded in place. The shaft 166 is secured to the flywheel 160 at a point radially displaced from the axis A, and thus, the shaft 166 rotates at a fixed radius about the axis A. In other words, the shaft 166 and the flywheel 160 cooperate to define a first crank having a first crank radius.

A roller 170 is rotatably mounted on the shaft 166. The roller 170 on the right side of the apparatus 100 (from the perspective of a user facing away from the flywheels 160) rotates about an axis B, and the roller 170 on the left side of the apparatus 100 rotates about an axis C. In the embodiment 100, each of the rollers 170 has a smooth cylindrical surface which bears against and supports a rearward portion or end 182 of a respective force receiving member 180. In particular, the roller 170 protrudes laterally into a slot 187 provided in the rearward end 182 of the force receiving member 180. The height of the slot 187 is greater than the diameter of the roller 170, so the lower surface of the slot 187 does not prevent the roller 170 from rolling back and forth across the upper surface of the slot 187. Those skilled in the art will recognize that other structures (e.g. the shaft 166 alone) could be used in place of the roller 170. Those skilled in the art will also recognize that the roller may be said to be interconnected between the flywheel 160 and the force receiving member 180 and/or to provide a means for interconnecting the flywheel 160 and the force receiving member 180.

A rigid member or first link 190 has a first end 191 which is fixedly secured to the distal end of the shaft 166 by means known in the art. The first link 190 extends to a second, opposite end 192 which occupies a position radially displaced from the axis A, and which rotates at a fixed radius about the axis A. In other words, the second end 192 of the first 190 and the flywheel 160, together with the parts interconnected therebetween, cooperate to define a second crank having a second, relatively greater crank radius. Those skilled in the art will recognize that the second crank and the first crank are portions of a single unitary member and share a common rotational axis A.

A second link 200 has a rearward end 202 rotatably connected to the second end 192 of the first link 190 by means known in the art. For example, holes may be formed through the overlapping ends 192 and 202, and a fastener 195 may be inserted through the aligned holes and secured in place. As a result of this arrangement, the second link 200 on one side of the apparatus 100 rotates about an axis D relative to its respective fastener 195 and flywheel 160; and the second link 200 on the other side of the apparatus 100 rotates about an axis E relative to its respective fastener 195 and flywheel 160. Those skilled in the art will recognize that the exact location of the axes D and E relative to the other axes A, B, and C, as well as one another, is a matter of design choice.

The second link 200 has a forward end 203 rotatably connected to an intermediate portion 183 of the force receiving member 180 by means known in the art. For example, a pin 205 may be secured to the force receiving member 180, and a hole may be formed through the forward end 203 of the second link 200 to receive the pin 205. As a result of this arrangement, the second link 200 may be said to be rotatably interconnected between the flywheel 160 and the force receiving member 180, and/or to provide a discrete means for interconnecting the flywheel 160 and the force receiving member 180.

Each force receiving member 180 has a forward end 181 which is movably connected to the frame 120, as well as a rearward end 182 (connected to the roller 170) and an intermediate portion 183 (connected to the second link 200). In this regard, right and left rails or supports 210 extend from relatively rearward ends, which are connected to the base 122 proximate the floor surface 99, to relatively forward ends, which are supported above the floor surface 99 by posts 129. A longitudinally extending slot 214 is provided in each rail 210 to accommodate a respective bearing member 215. The forward end 181 of each force receiving member 180 is provided with opposing flanges 185 which occupy opposite sides of a respective rail 210 and are connected to opposite ends of a respective bearing member 215. In other words, the bearing member 215 movably connects the force receiving member 180 to the rail 210 and/or may be described as a means for interconnecting the force receiving member 180 and the frame 120.

In the embodiment 100, the bearing member 215 is a roller which is rotatably mounted on the force receiving member 180 and rollable across a bearing surface within the slot 214. However, the bearing member could instead be a stud which is rigidly secured to the force receiving member and slidable across a bearing surface within the slot. The intermediate portion 183 of the force receiving member 180 may be described as that portion between the first end 181 and the second end 182. In addition to connecting with the second link 200, the intermediate portion 183 provides a support surface 188 which is sized and configured to support at least one foot of a person using the apparatus 100.

In operation, rotation of the flywheel 160 causes the shaft 166 to revolve about the axis A, and the roller 170 causes the support surface 188 to move up and down relative to the frame 120, through a range of motion approximately equal to twice the radial distance between the axis A and either axis B or C. Rotation of the flywheel 160 also causes the second end 192 of the first link 190 to revolve about the axis A, and the second link 200 causes the support surface 188 to move back and forth relative to the frame 120, through a range of motion approximately equal to twice the radial distance between the axis A and either axis D or E. In other words, the present invention provides an apparatus and method for moving a force receiving member through a path having a horizontal component which is not necessarily related to or limited by the vertical component. As a result, it is a relatively simple matter to design an apparatus with a desired "aspect ratio" for the elliptical path to be traveled by the foot platform. For example, movement of the axes D and E farther from the axis A and/or movement of the axes B and C closer to the axis A will result in a relatively flatter path of motion. Ultimately, the exact size, configuration, and arrangement of the components of the linkage assembly 150 are a matter of design choice.

Those skilled in the art will also recognize that each of the components of the linkage assembly 150 is necessarily long enough to facilitate the depicted interconnections but need not terminate immediately beyond the points of connection. For example, the links 190 and 200 must be long enough to interconnect the flywheel 160 and the force receiving member 180 and accommodate a particular crank radius. Furthermore, for ease of reference in both this detailed description and the claims set forth below, the components are sometimes described with reference to "ends" being connected to other parts. For example, the link 190 may be said to have a first end rigidly secured to the shaft 166 and a second end rotatably connected to the second link 200. However, the term "end" should be interpreted broadly, in a manner that could include "rearward portion" and/or "behind an intermediate portion", for example.

Those skilled in the art will further recognize that the above-described components of the linkage assembly 150 may be arranged in a variety of ways. For example, in each of FIGS. 6*a*–6*j*, flywheels 160', support rollers 170', links 190', and links 200' are shown in several alternative configurations relative to one another and the frame 120' (in some embodiments, there is no need for a discrete link 190' because both the links 200' and the rollers 170' are connected directly to the flywheels 160').

Figure 8:
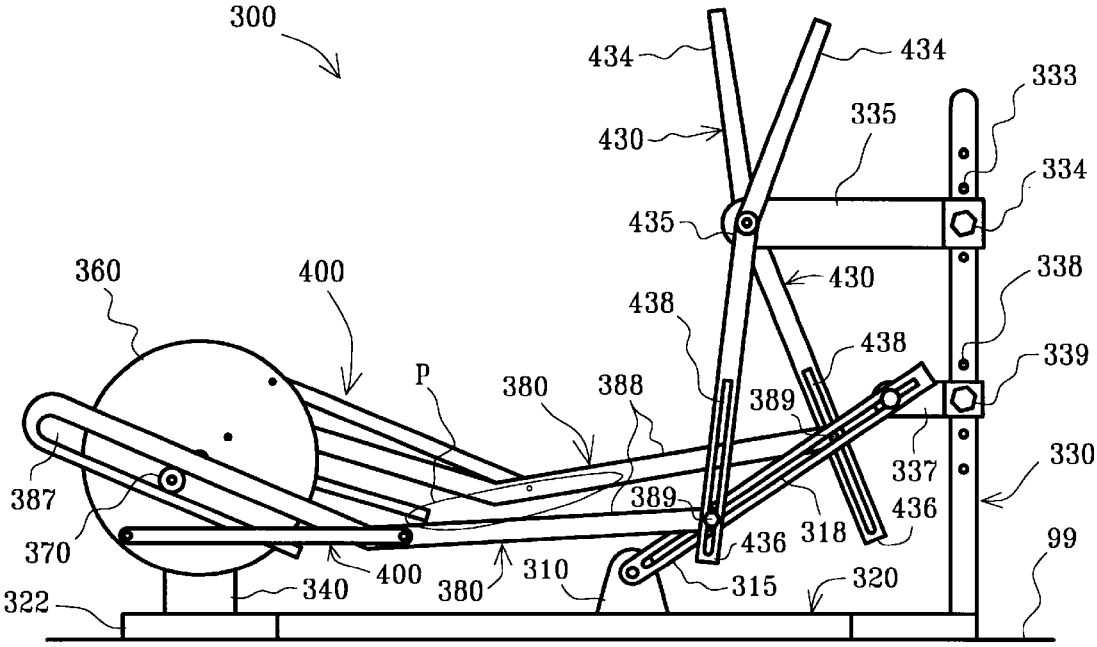
FIG. 8 is a side view of another exercise apparatus constructed according to the principles of the present invention.

Another embodiment of the present invention is designated as 300 in FIG. 8. The exercise apparatus 300 includes a frame 320 having a base 322, a forward stanchion 330, a rearward stanchion 340, and an intermediate stanchion 310. When the base 322 is resting upon a floor surface 99, each of the stanchions 310, 330, 340 extends generally perpendicularly upward from the base 322.

A flywheel 360 is rotatably mounted on the rearward stanchion 340, and a roller 370 is rotatably mounted on the flywheel 360 at a first radially displaced location. A rearward portion of a force receiving member 380 rests upon the roller 370. In particular, the rearward portion of the force receiving member is configured to define a slot 387, and the roller 370 protrudes laterally into the slot 387 and bears against the upper wall or surface which borders the slot 387.

An intermediate portion of the force receiving member 380 extends at an obtuse angle from the rearward portion and provides a foot supporting surface 388. A first end of a rigid link 400 is rotatably connected to the flywheel 360 at a second radially displaced location. A second, opposite end of the link 400 is rotatably connected to the intermediate portion of the force receiving member 380.

A roller 389 is rotatably mounted on a forward end of the force receiving member 380. The roller 389 rolls or bears against a ramp 315 having a first end rotatably connected to the intermediate stanchion 310, and a second, opposite end connected to a trunnion 337. A slot 318 is provided in the ramp 315 both to accommodate the roller 389 and to facilitate angular adjustment of the ramp 315 relative to the frame 320 and the floor surface 99. With regard to the latter function, the trunnion 337 is slidably mounted on the forward stanchion 330, and a pin 339 may be selectively inserted through aligned holes 338 in the trunnion 337 and the stanchion 330 to secure the trunnion 337 in any of several positions above the floor surface 99. As the trunnion 337 slides downward, the fastener which interconnects the trunnion 337 and the ramp 315 is free to move within the slot 318.

A lower portion 436 of a handle member 430 is movably connected to the forward end of the force receiving member 380, adjacent the roller 389. In particular, a common shaft extends through the force receiving member 380, the roller 389, and a slot 438 provided in the lower portion 436. An opposite, upper end of the handle member 430 is sized and configured for grasping by a person standing on the force receiving member 380. An intermediate portion 435 of the handle member 430 is rotatably connected to a trunnion 335 which in turn, is slidably mounted on the forward stanchion 330 above the trunnion 337. A pin 334 may be selectively inserted through aligned holes 333 in the trunnion 335 and the stanchion 330 to secure the trunnion 335 in any of several positions above the floor surface 99. The slot 438 in the handle member 430 both accommodates height adjustments and allows the handle member 430 to pivot about its connection with the trunnion 335 while the roller 389 moves through a linear path of motion. As a result of this arrangement, the height of the handle member 430 can be adjusted without affecting the path of the foot support 380, and/or the path of the foot support 380 can be adjusted without affecting the height of the handle member 430, even though the two force receiving members 380 and 430 are linked to one another.

In view of the foregoing, the apparatus 300 may be said to include means for linking rotation of a crank 360 to generally elliptical motion of a force receiving member 380 (through a path P), and/or means for linking the generally elliptical motion of the force receiving member 380 to reciprocal motion of another force receiving member 430.

Figure 9:
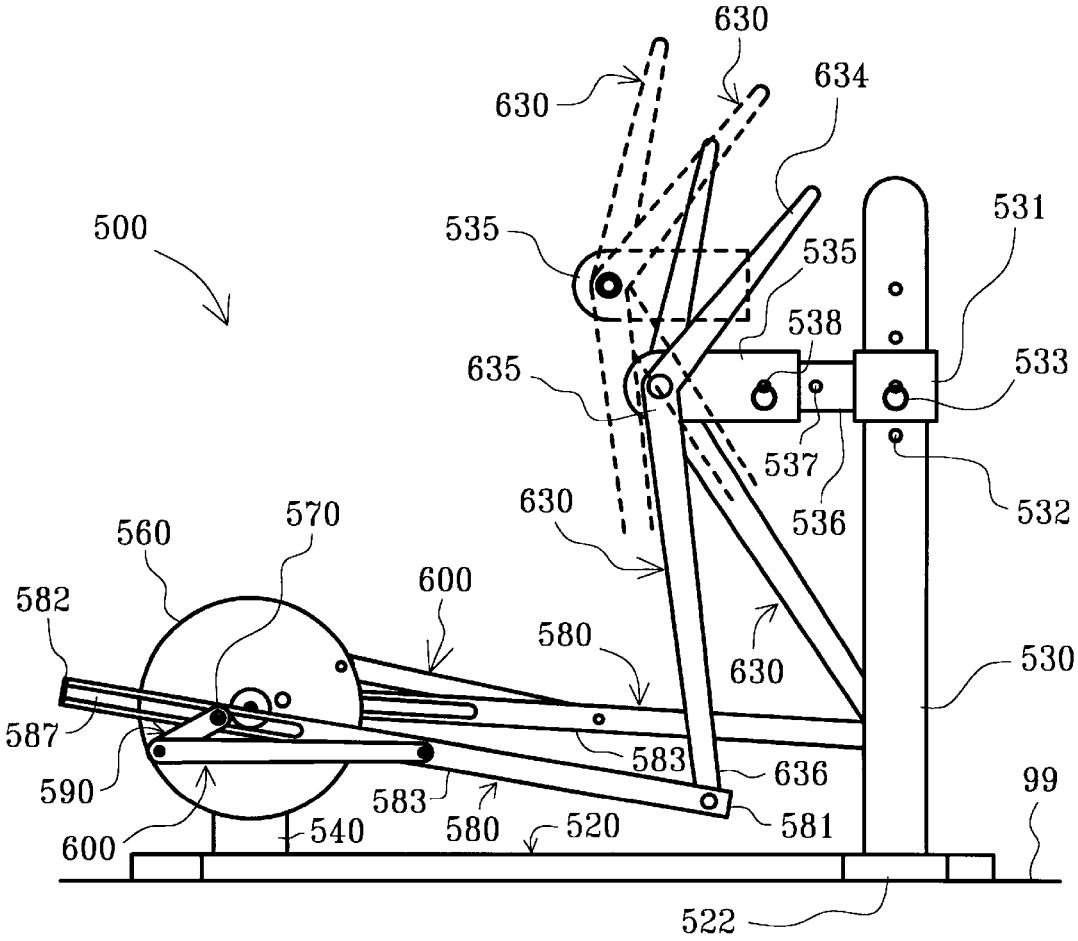
FIG. 9 is a side view of yet another exercise apparatus constructed according to the principles of the present invention.

Yet another embodiment of the present invention is designated as 500 in FIG. 9. The exercise apparatus 500 includes a frame 520 having a base 522, a forward stanchion 530, and a rearward stanchion 540. The base 522 is configured to rest upon a floor surface 99, and each of the stanchions 530 and 540 to extend generally perpendicularly upward from the base 522.

A flywheel 560 is rotatably mounted on the rearward stanchion 540, and a roller 570 is rotatably mounted on the flywheel 560 at a first radially displaced location. A rearward portion 582 of a force receiving member 580 rests upon the roller 570. In particular, the rearward portion 582 of the force receiving member 580 is configured to define a slot 587, and the roller 570 protrudes laterally into the slot 587 and bears against the upper wall or surface which borders the slot 587.

A first rigid link 590 has a first end rigidly secured to the shaft which supports the roller 570, and a second, opposite end which occupies a second radially displaced position relative to the crank axis. A first end of a second rigid link 600 is rotatably connected to the second end of the first link 590. A second, opposite end of the link 600 is rotatably connected to an intermediate portion 583 of the force receiving member 580. The intermediate portion 583 is sized and configured to support a person's foot.

A forward end 581 of the force receiving member 580 is rotatably connected to a lower end 636 of a third link or pivoting handle member 630. An opposite, upper end 634 of the handle member 630 is sized and configured for grasping by a person standing on the intermediate portion 583 of the force receiving member 580. An intermediate portion 635 of the handle member 630 is rotatably connected to a trunnion 535 on the frame 520. The trunnion 535 is slidably mounted on a laterally extending support 536, which in turn, is slidably mounted on the forward stanchion 530. A pin 533 inserts through aligned holes 532 in the stanchion 530 and the support 536 to secure the support 536 (and the trunnion 535) at any one of a plurality of distances above the floor surface 99. A pin 538 inserts through aligned holes 537 in the support 536 and the trunnion 535 to secure the trunnion 535 at one of a plurality of distances from the forward stanchion 530. As a result of this arrangement, the handle member 630 may be said to be rotatably interconnected between the force receiving member 580 and the frame 520 and/or to provide a means for interconnecting the force receiving member 580 and the frame 520. The handle member 630 may also be said to be rotatably interconnected between the force receiving member 580 and the frame 520, and/or to provide a means for interconnecting the force receiving member 580 and the frame 520.

Figure 10:
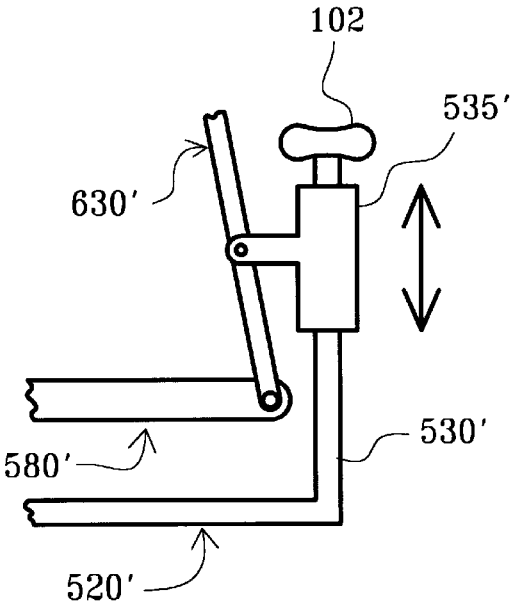
FIG. 10 is a diagrammatic side view of an elevation adjustment mechanism suitable for use on exercise apparatus constructed according to the present invention.

On each of the foregoing alternative embodiments, adjustments are made relative to the forward stanchion by means of ball detent pins inserted through aligned holes in overlapping frame members. Another suitable adjustment mechanism is shown diagrammatically in FIG. 10, wherein a frame 520' includes a support 535' movable along an upwardly extending stanchion 530', and a pivoting member 630' is rotatably interconnected between the support 535' and a force receiving member 580'. A knob 102 is rigidly secured to a lead screw which extends through the support 535' and threads into the stanchion 130'. The knob 102 and the support 535' are interconnected in such a manner that the knob 102 rotates relative to the support 535', but they travel up and down together relative to the stanchion 130' (as indicated by the arrows) when the knob 102 is rotated relative to the stanchion 530'.

Figure 11:
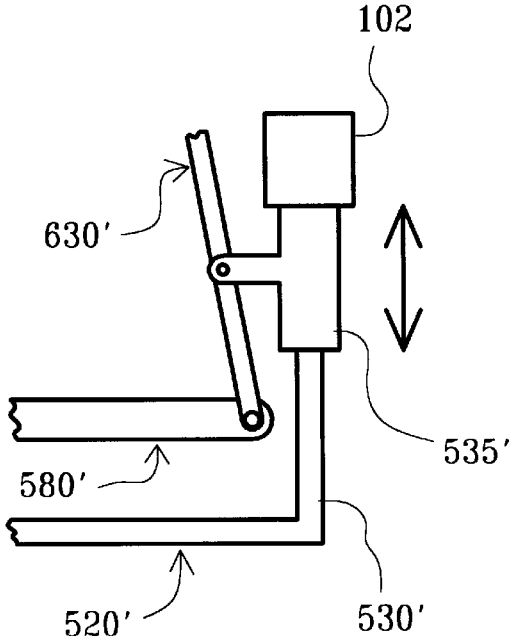
FIG. 11 is a diagrammatic side view of another elevation adjustment mechanism suitable for use on exercise apparatus constructed according to the present invention.

Yet another suitable adjustment mechanism is shown diagrammatically in FIG. 11, wherein a frame 520' includes a support 535' movable along an upwardly extending stanchion 530', and a pivoting member 630' is rotatably interconnected between the support 535' and a force receiving member 580'. A powered actuator 104, such as a motor or a hydraulic drive, is rigidly secured to the support 535' and connected to a movable shaft which extends through the support 535' and into the stanchion 130'. The actuator 104 selectively moves the shaft relative to the support 535', causing the actuator 104 and the support 535' to travel up and down together relative to the stanchion 130' (as indicated by the arrows). The actuator 104 may operate in response to signals from a person and/or a computer controller.

Although the present invention has been described with reference to specific embodiments and particular applications, those skilled in the art will recognize additional embodiments, modifications, and/or applications which fall within the scope of the present invention. For example, the spatial relationships, including the radii and/or angular displacement of the crank axes, may vary for different sizes, configurations, and/or arrangements of the components of the linkage assembly. Also, the present invention could be fitted with any of various known inertia altering devices, including, for example, a motor, a "stepped up" flywheel, or an adjustable brake of some sort. Furthermore, although some of the rotationally interconnected components are shown to be simply cantilevered relative to one another, they could be modified so that an end of a first component, such as the second link 200, nested between opposing prongs on the end of a second component, such as the first link 190. Recognizing that practical considerations necessarily limit the foregoing description to only a few of the numerous possible modifications and variations, the scope of the present invention is to be limited only to the extent of the claims which follow.

What is claimed is:

1. An exercise apparatus, comprising:

a frame designed to rest upon a floor surface;

a ramp mounted on said frame;

left and right cranks rotatably mounted on said frame and rotatable about a common crank axis;

left and right foot supporting members having rearward portions movably connected to respective cranks, intermediate portions sized and configured to support a person's respective feet, and forward portions movably connected to said ramp and constrained to move in reciprocal fashion relative to said ramp as said cranks rotate relative to said frame; and left and right handle members having upper portions sized and configured for grasping, intermediate portions rotatably mounted on said frame and pivotal about a common pivot axis, and lower portions movably connected to said forward portions of respective foot supports at respective connection points, wherein said handle members are constrained to pivot about said pivot axis as said forward portions move back and forth along said ramp, and said connection points are constrained to travel along respective paths relative to respective handle members as said handle members pivot about said pivot axis, and each of said paths extends radially toward said pivot axis.

2. The exercise apparatus of claim 1, wherein each of said forward portions cooperates with said ramp to define a respective first moving axis, and each of said forward portions cooperates with a respective one of said handle members to define a respective second moving axis, and each said first moving axis is coaxial with a respective second moving axis.

3. The exercise apparatus of claim 1, wherein left and right rollers are rotatably mounted on respective forward portions.

4. The exercise apparatus of claim 3, wherein left and right shafts extend through respective rollers and through respective handle members.

5. The exercise apparatus of claim 4, wherein said shafts are movable along slots provided in respective handle members.

6. The exercise apparatus of claim 1, wherein left and right shafts extend through respective forward portions and through respective handle members.

7. The exercise apparatus of claim 1, wherein said ramp is selectively movable relative to said frame to change an angle defined between said ramp and the floor surface.

8. The exercise apparatus of claim 1, wherein said intermediate portions of said handle members are rotatably mounted on a bracket, and said bracket is selectively movable relative to said frame to change a distance defined between said pivot axis and the floor surface.

9. The exercise apparatus of claim 1, wherein slots are provided in said handle members to accommodate up and down movement of said forward portions relative to said handle members.

10. An exercise apparatus, comprising:

a frame designed to rest upon a floor surface;

a ramp mounted on said frame;

left and right cranks rotatably mounted on said frame and rotatable about a common crank axis;

left and right foot supporting members having rearward portions movably connected to respective cranks, intermediate portions sized and configured to support a person's respective feet, and forward ends connected to respective left and right rollers in such a manner that said rollers are constrained to move in reciprocal fashion relative to said ramp as said cranks rotate relative to said frame; and left and right handle members having upper portions sized and configured for grasping, intermediate portions rotatably mounted on said frame and pivotal about a common pivot axis, and lower portions movably connected to respective foot supports in such a manner that said forward ends of said foot supports are constrained to move linearly along respective handle members, and said handle members are constrained to pivot about said pivot axis as said rollers move in reciprocal fashion relative to said ramp.

11. The exercise apparatus of claim 10, wherein each of said rollers defines a respective first moving axis, and each of said forward ends cooperates with a respective one of said handle members to define a respective second moving axis, and each said first moving axis is coaxial with a respective second moving axis.

12. The exercise apparatus of claim 10, wherein left and right shafts extend through respective rollers and through respective handle members.

13. The exercise apparatus of claim 12, wherein said shafts are movable along slots provided in respective handle members.

14. The exercise apparatus of claim 10, wherein left and right shafts extend through respective forward ends and through respective handle members.

15. The exercise apparatus of claim 10, wherein said ramp is selectively movable relative to said frame to change an angle defined between said ramp and the floor surface.

16. The exercise apparatus of claim 10, wherein said intermediate portions of said handle members are rotatably mounted on a bracket, and said bracket is selectively movable relative to said frame to change a distance defined between said pivot axis and the floor surface.

17. The exercise apparatus of claim 10, wherein slots are provided in said handle members to accommodate movement of said forward ends along said handle members.

* * * * *